US006076742A

United States Patent [19]

Benary

[11] Patent Number: 6,076,742

[45] Date of Patent: Jun. 20, 2000

[54] ARC THERMAL SPRAY GUN EXTENSION WITH CONICAL SPRAY

[75] Inventor: Raphael Benary, East Northport, N.Y.

[73] Assignee: Sulzer Metco (US) Inc., Westbury, N.Y.

[21] Appl. No.: 09/266,332

[22] Filed: Mar. 11, 1999

[51] Int. Cl.[7] ..... B05B 1/24

[52] U.S. Cl. ..... 239/84; 239/81; 239/290; 219/76.14

[58] Field of Search ..... 239/79, 81, 83, 239/84, 290, 296, 297; 219/76.14, 76.16

[56] References Cited

U.S. PATENT DOCUMENTS

| | | | |
|---|---|---|---|
| 3,141,616 | 7/1964 | Cauchetier | 239/84 X |
| 3,546,415 | 12/1970 | Marantz . | |
| 4,095,081 | 6/1978 | Ashman . | |
| 4,492,337 | 1/1985 | Harrington et al. . | |
| 4,668,852 | 5/1987 | Fox et al. . | |
| 4,720,044 | 1/1988 | Stemwedel, Jr. | 239/84 |
| 4,853,513 | 8/1989 | Fuimefreddo . | |
| 5,245,153 | 9/1993 | Singer et al. . | |
| 5,584,433 | 12/1996 | Nakagawa | 239/83 X |
| 5,714,205 | 2/1998 | Maratz et al. . | |
| 5,791,560 | 8/1998 | Rogers et al. . | |
| 5,964,405 | 9/1999 | Benary et al. | 239/84 |

*Primary Examiner*—Lesley D. Morris
*Attorney, Agent, or Firm*—Chadbourne & Parke LLP

[57] ABSTRACT

In a two-wire arc spray extension two metal wires are guided into contact, and a gas cap is affixed to a gun body. The feeding wires receive an arc current to effect an arc and thereby molten metal at the wire tips. The gas cap has a plurality of orifices therein that receive pressurized gas to generate gas jets. The orifices are disposed with substantially equal spacing arcuately such that the jets are directed with a radially inward component toward the tips to effect atomization of the molten metal into a spray stream. The orifices have axes that are offset forwardly and tangentially from radial so as to create a vortex flow such that the spray stream is effected in the form of a conical fan. Insertion of the spray stream centrally into a hole can effect a coating circumferentially on an inside surface of the hole.

12 Claims, 5 Drawing Sheets

ARC THERMAL SPRAY GUN EXTENSION WITH CONICAL SPRAY

This invention relates to thermal spray apparatus and particularly to a dual wire, arc type of thermal spray gun.

BACKGROUND

Thermal spraying is a process of melting and propelling fine particles of molten material such as metal to form a coating. One or two wires or a powder may be used for feed material, and heating is by an electrical arc or a combustion flame. One type of thermal spray gun is a dual wire, arc thermal spray gun, in which two wires are fed into contact at the wire tips that are melted by an electrical arc with current passed through the wires. A jet of compressed gas (usually air) is blown through the tips to atomize (i.e. nebulize) the molten metal and effect a spray stream of molten metal particles. Arc current generally is of the order of hundreds of amperes. A variety of gas head configurations have been suggested, for example as disclosed in U.S. Pat. Nos. 3,546,415, 4,095,081, 4,492,337, 4,668,852, 5,714,205, and 5,791,560.

Some applications involve coating inside surfaces of holes or other confined areas such as cylinder bores. For such applications an extension gun is used in which a gas jet from the side deflects the spray at an angle from the main axis so that the gun can be inserted into the hole with the angled or deflected spray directed to the surface. The side jet may be auxiliary to a central atomizing jet and may or may not serve as the primary atomizing jet. For spraying an inside surface of a hole, such as a cylinder bore of an internal combustion engine, either the gun must be rotated on its axis or the object with the hole must be rotated at a fairly high speed while the gun is moved axially. Such rotation of an object such as a cylinder block is generally impractical. Single wire combustion gun extensions or powder guns can be rotated with appropriate mechanisms. A single wire arc gun with a rotating non-consumable electrode is disclosed in U.S. Pat. No. 5,245,153, but single wire arc guns have not become commercially viable, at least in part because such electrodes are really not "non-consumable" at the high currents.

Angular two wire arc guns are disclosed in U.S. Pat. No. 4,853,513 and in patent application Ser. No, 09/038,435, filed Mar. 11, 1998 of the present inventor and assignee. For a two wire gun, a complex system is necessary to rotate the spray head about the wires to avoid twisting. Irregular spraying can be expected from the varying geometry with respect to the converging wires. Spraying with a two wire arc gun is relatively cheap and, therefore, desirable for many applications.

Accordingly, an object of the invention is to provide an improved, dual wire, extension type of arc thermal spray apparatus for spraying inside of a hole in an object without need for rotating the spray apparatus or the object. Another object is to provide such an apparatus that effects a conical fan spray for spraying inside of holes. A further object is to provide a novel gas cap for such an apparatus in order to achieve the foregoing objects.

SUMMARY

The foregoing and other objects are achieved, at least in part, with an arc spray extension apparatus for spraying into holes, the apparatus having a spray gun body, a pair of tubular wire guides held convergingly by the gun body so as to guide two metal wires to a region of contact at tips of the wires, a wire feeding mechanism operatively connected to feed the wires respectively through the wire guides, and a gas cap affixed to the gun body and extending forwardly therefrom. The wires are receptive of an arc current to effect an arc and thereby molten metal at the wire tips.

The gas cap has a plurality of orifices therein receptive of pressurized gas to generate gas jets. The orifices are disposed with substantially equal spacing arcuately such that the jets are directed with a radially inward component toward the region of contact to effect atomization of the molten metal into a spray stream. The orifices have axes that are uniformly offset forwardly and tangentially from radial so as to create a vortex flow such that the spray stream is effected in the form of a conical fan. Insertion of the spray stream centrally into a hole can effect a coating circumferentially on an inside surface of the hole.

DETAILED DESCRIPTION

Figure 1:
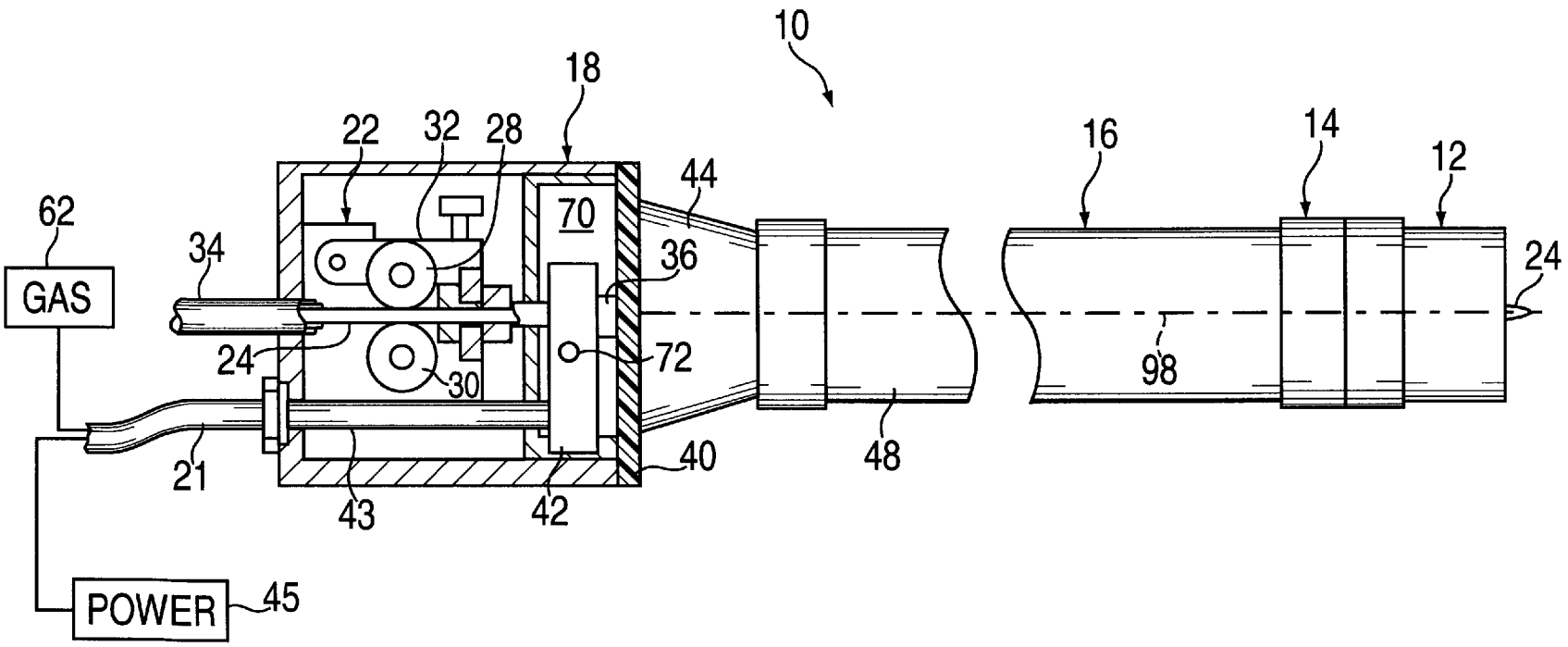
FIG. 1 is a longitudinal view, partially in section, of an arc wire thermal spray apparatus incorporating the invention.

A dual wire, arc thermal spray gun 10 (FIG. 1) incorporating the invention may be a conventional or other desired type except with respect to a gas cap 12 described herein. In the present example, a gun body has three portions, namely a forward gun body 14, an elongated middle gun body 16 and a rear gun body 18. The rear body separates gas and power from a pair of hose cables 21, and also contains a wire drive mechanism 22. The front gun body brings two wires 24 together for arcing and has the gas cap 12 for atomizing and producing a spray stream from the molten wire tips. The middle gun body is an extender that links the front and rear gun bodies. A console (not shown) typically contains a rectifier, a gas regulator and supports for wire reels, to supply power, wire and gas to the gun.

(As used herein and in the claims, the terms "forward" and "front" are with reference to the direction in which the wires are driven, and "rear" and "rearward" denote the opposite direction. The terms "inner" and "inward" mean facing or directed toward the gun axis.)

Figure 2A:
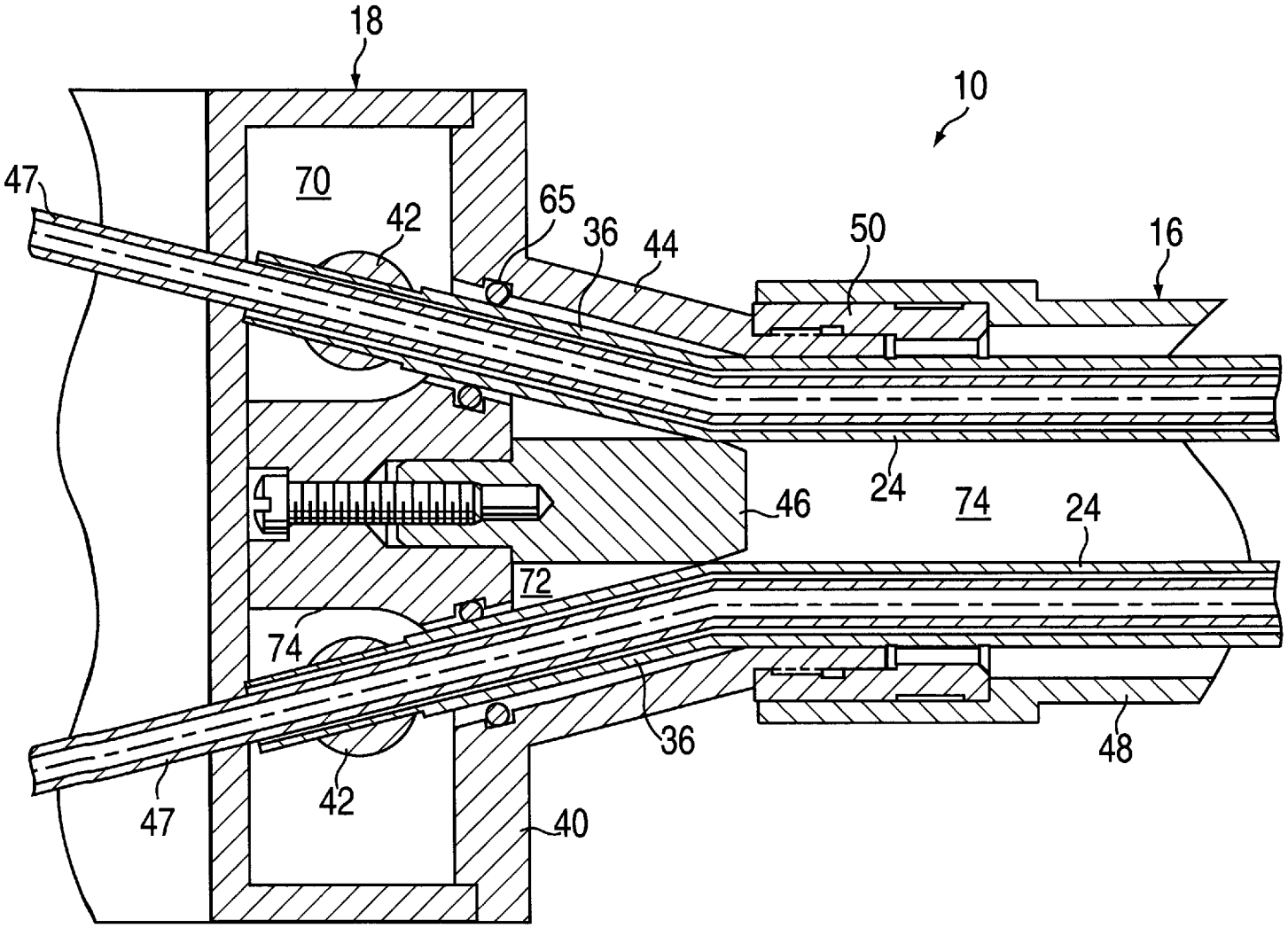
FIG. 2A is a longitudinal section of a rear portion of the thermal spray apparatus of FIG. 1.

In the present example, the rear gun body 18 contains the wire drive mechanism 22. Such a wire drive may utilize a small, variable speed electric motor or air motor (not shown) which drives gears connected to electrically insulated feed rollers 30, with roller tension maintained for each wire with a spring tension device 32 urging insulated idler rolls 28 located above the feed rollers. Wires 24 leading through flexible tubing 34 from spools or wire containers (not shown) are thereby fed by the rollers through and into wire tubes 36 (FIG. 2A). The type or location of the wire drive is not important to this invention, and any other suitable conventional or other desired mechanism may be used. A push drive at the reels may be used to replace or supplement the wire drive in the gun.

A support block 40 forward of the drive mechanism contains vertical contact posts 42, the bases of which are attached to rigid tubes 43 connecting from the power cables 21 which, in turn, are connected to a conventional source of electrical power 45 for effecting an arc. The conductive wire tubes 36 are secured for support and electrical contact in diametric holes in the posts. These tubes angle inwardly in a tapered section 44 of the support block, and then straighten out to extend in parallel along the middle gun body 16. The tubes are supported in the tapered section by a centering post 46.

The wire tubes 36 advantageously contain tube liners 47, preferably formed of a low friction material such as plastic imbedded with PTFE or $MoS_2$. The liners enter the tubes rearwardly of the vertical posts 42 and continue inside the tubes in the middle gun body. The middle gun body has an elongated, cylindrical extension housing 48 with an end fitting 50 at the rear fastened to the forward end of the taper section. The middle gun body has a selected length for a particular application depending on depth of hole or other confined area to be sprayed, for example 30 cm or 60 cm.

Figure 2B:
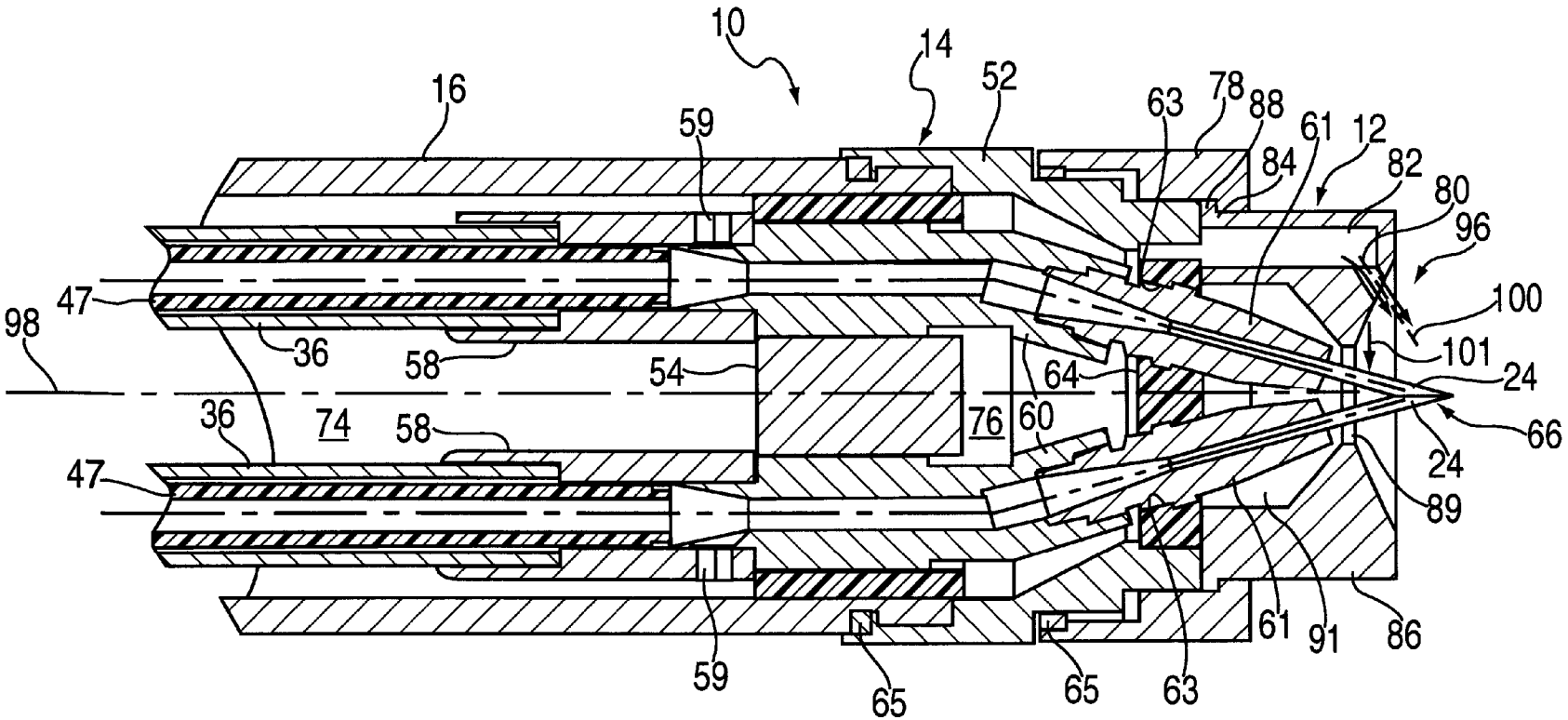
FIG. 2B is a longitudinal section of a forward portion of the thermal spray apparatus of FIG. 1.
Figure 3:
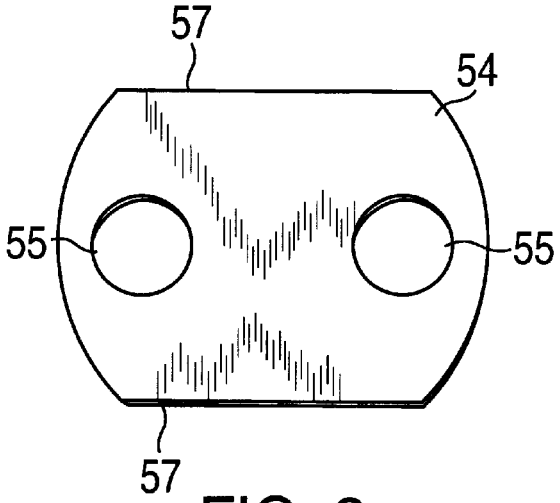
FIG. 3 is a front view of a support member shown in FIG. 2B.

The forward gun body 14 (FIG. 2B) is generally cylindrical and includes a front member 52 threaded to the extension housing. A support member 54 affixed within the front body has a pair of through holes 55 (FIG. 3) and is truncated 57 on opposite sides for air flow (explained below). The support member holds in the through holes a pair of angular guides 60 that extend forwardly from these fittings through the support member and then bend inwardly. These guides and the holes 55 alternatively may have a rectangular or other cross section for manufacturing convenience. A pair of termination fittings 58 are affixed with pins 59 to the guides 60 rearwardly thereof for connecting to the forward ends 30 of the wire tubes 36 and the tube liners 47.

Figure 4:
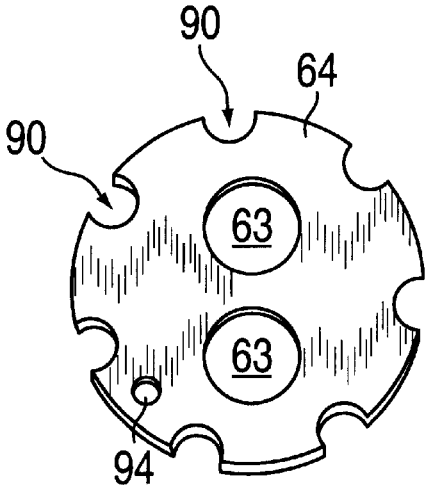
FIG. 4 is a front view of a support disk shown in FIG. 2B.

Conductive wire guides 61 are threaded into the converging forward ends of the angular guides 60. The wire guides are positioned through respective holes 63 in a support disk 64 (FIG. 4) that is retained in the front member 52. These tubes contact the wires electrically to provide the electrical current through the wires, and converge the wires to a region of contact 66 of the wires. With a conventional source of arc power (typically DC) applied through the wires, an electric arc will be formed, thus melting the wire tips. From the power source 45 (FIG. 1), power is supplied from its line source via a rectifier in the console and hence through the cables 21, the wire tubes 36, the angular guides 60 and the wire guides 61 to the wires 24.

All components are held together conventionally, as partially illustrated, by screws, threading, epoxy, press fitting, or the like. At least the rear gun body may have a removable cover for access to the drive mechanism. Appropriate parts are formed of electrical insulating material, such as a hard plastic, including the tapered section in the rear gun body and the supports in the forward gun body.

Atomizing air or other gas from a primary source 62 (FIG. 1) of compressed gas is brought through the cable hoses 21 and the rigid tube 43 to the bases of the support posts 42 (along with the power). Lateral holes 72 in the posts feed the air into a chamber 70 in the block 40. Four holes (not shown) in a forward wall 74 of the block lead the air to a second chamber 72 (FIG. 2A) in the taper section 44 and thence through a duct 74 formed by the housing 48 of the middle gun body. The air flows past the truncated support member 54 to a forward chamber 76. O-ring seals 65 are used stragetically to contain the compressed gas.

The structural details of the foregoing aspects of the arc gun apparatus, for the purposes of the present invention, are not important and need not be limited to the present example. Other configurations may be used. For example, the extension housing 48 may be omitted and, in place, rigid tubes used for conveying the wires, power and gas and providing support between the rear and forward gun bodies, as taught in the aforementioned U.S. Pat. No. 4,853,513, except with straight tubes, the portions thereof relevant to such conveyance and support being incorporated herein by reference. (Actually the tubes need not be straight for special spraying configurations.)

Similarly, details of physical connections for the housing and tubes are not important. The type of electrical contact to the wires is also not important to the present invention, and any other conventional or desired contact means such as through the rollers may be used. For example, electrical contact may be effected remotely from the gun such as at the mounting for reels of the wires. Broadly, what is required more generally is a connection of power to the wires, reception by the gun of the two wires, a wire drive mechanism (that may be in anywhere in the wire train), a front gun body to bring the wires into the region of contact for arcing, and power and a gas supply to the front gun body (unless the power is conducted to the wires somewhere rearwardly). An extension support for the front gun body is generally needed unless the hole is shallow.

Figure 5:
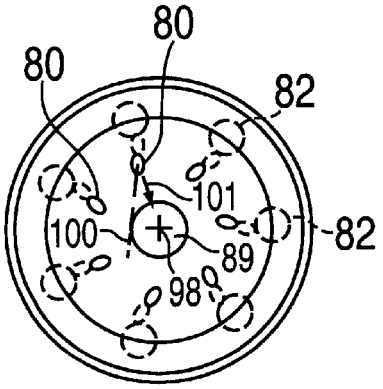
FIG. 5 is a front view of a gas cap shown in FIGS. 1 and 2B.
Figure 6:
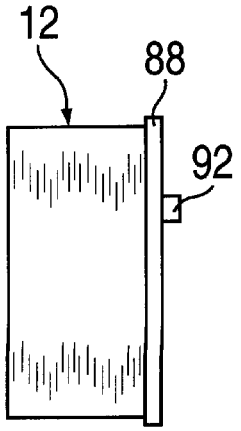
FIG. 6 is a perspective of the apparatus of FIG. 1 showing a spray stream in the form of a conical fan for spraying in a hole.

The gas cap 12 (FIGS. 2B, 5 and 6) is attached with a threaded retaining ring 78 (or other suitable fastening system such as screws, detents or threading of the gas cap) to the front member 52 of the forward gun body. The gas cap has a base section 84 with a projection section 86 extending forwardly therefrom. The base is adapted for affixing the gas cap to the gun body, for example having a flange 88 in the present example for retaining by the ring 78. Thus the gas cap is readily replacable either when worn or for interchangibility with other types of gas caps. The gas cap has a central opening 89 through which the wires 24 converge, and a central cavity 91 of suitable size for the wire guides 61.

The gas cap has a plurality of orifices 80 therein, preferably between 3 and 13 (inclusively) in number, such as 7 orifices as shown. A gas channel 82 for each orifice connects from the orifice through the base. The support disk 64 (FIG. 4) has a corresponding plurality of indentations 90 in the circumference that align with the gas channels. An offset pin 92 (FIG. 6) in the base is used to orient the gas cap in a corresponding hole 94 in the support disk providing the alignment. Gas from the chamber 76 passes through the respective indentations and gas channels to each of the orifices to generate gas jets 96.

The orifices 80 are disposed with substantially equal spacing arcuately such that the jets are directed with a radially inward component toward the region of contact to effect atomization of the molten metal into a spray stream. The orifices have axes 100 (one shown) that preferably are offset forwardly (FIG. 2B) from radial 101, radial being normal to the gun axis 98. The axes are offset tangentially (FIG. 5) from radial so as to create a vortex flow such that the spray stream is effected in the form of a conical fan. The offsets should be uniform so as to effect a uniform spray and are selected so as to effect the fan. The forward offset should be between about 5° and 60° from radial, for example 21°.

The tangential offset should be between about 10° and 30° from radial, for example 18°. (The orifice axes are not necessarily tangential to the central opening 89.) The orifice size should produce a choked flow sufficient to produce good atomization, for example 2.0 mm diameter with an air pressure from the source 62 of 5 bar gage (75 psig). These conditions with the respective offsets of 21° and 18° effect a conical fan spray of about 45°. Other orifice dimensions and angles and air pressure may be selected cooperatively to optimize the spray cone. The other ducts and channels in the cables and gun between the source and the orifices should be large enough not to provide significant pressure drop.

For the jets to be suitably directed, the gas cap preferably has a forwardly facing, preferably shallow, conical surface that is proximate the region of contact, with the orifices exiting from the conical surface. An angle of the surface from the gun axis generally between about 45° and 80°, for example 75° is suitable. Other configurations may be used, such as a curved surface or an inwardly facing cylindrical surface for the orifice exits, or the jets may exit from a front surface normal to the gun axis.

Figure 7:
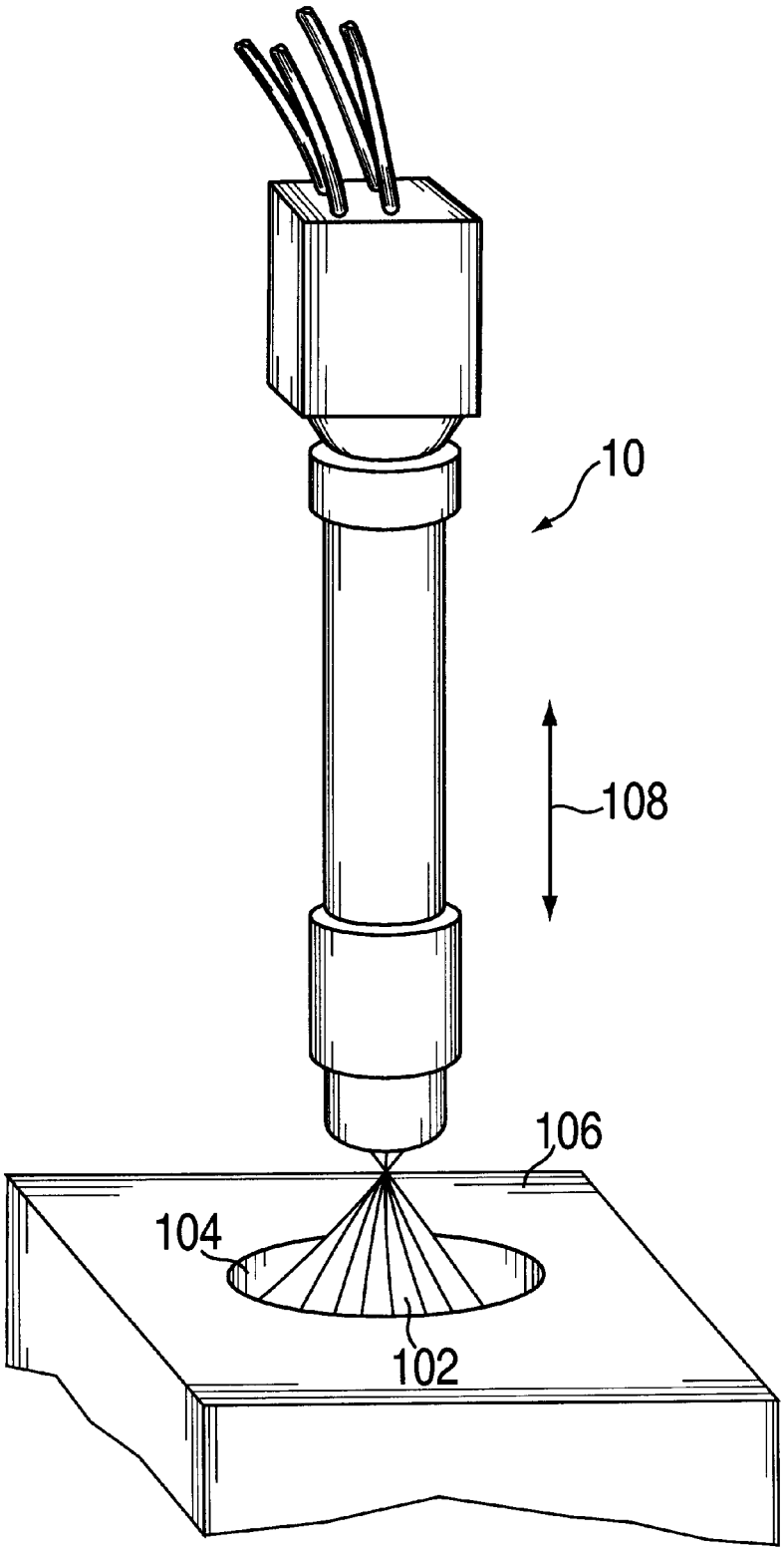
FIG. 7 is a view of the apparatus of FIG. 1 spraying in a hole.

Insertion of the conical fan spray stream 102 and, as necessary, the forward end of the gun, centrally into a hole 104 (FIG. 7) of an object 106 such as a cylinder block can effect a coating circumferentially on an inside surface of the hole without need for rotation of the gun or object. The gun may be held by hand, but usually should be mounted on an appropriate, conventional manipulator (not shown), and typically the gun will be moved axially 108 for longitudinal coating of the inside surface. The hole size may be any that is within a viable range of radial spray distances, generally between about 7 cm and 50 cm hole radius. The hole need not be cylindrical or of uniform size lengthwise, within this range. The apparatus is suitable for spraying engine cylinder bores, pump cylinder bores, conduction pipes, heat exchangers, combustion cans, syncro rings, and the like.

A gas cap of the invention may be used in other styles of two wire arc guns and different types of head members. In one embodiment, the gas cap comprises a simple projection extending from and formed integrally with the gun body. In other embodiments, gas caps according to the present invention may be fitted to variously configured guns with appropriate adaptation.

While the invention has been described above in detail with reference to specific embodiments, various changes and modifications which fall within the spirit of the invention and scope of the appended claims will become apparent to those skilled in this art. Therefore, the invention is intended only to be limited by the appended claims or their equivalents.

What is claimed is:

1. An arc spray extension apparatus for spraying into holes, comprising a spray gun body, a pair of tubular wire guides held convergingly by the gun body so as to guide two metal wires to a region of contact at tips of the wires, a wire feeding mechanism operatively connected to feed the wires respectively through the wire guides, and a gas cap affixed to the gun body and extending forwardly therefrom, the wires being receptive of an arc current to effect an arc and thereby molten metal at the wire tips;

the gas cap having a plurality of orifices therein receptive of pressurized gas to generate gas jets, the orifices being disposed with substantially equal spacing arcuately such that the jets are directed with a radially inward component toward the region of contact to effect atomization of the molten metal into a spray stream, the orifices having axes that are uniformly offset forwardly and tangentially from radial so as to create a vortex flow such that the spray stream is effected in the form of a conical fan, whereby insertion of the spray stream centrally into a hole can effect a coating circumferentially on an inside surface of the hole.

2. The apparatus of claim 1 wherein the gas cap has a forwardly facing depressed conical surface proximate the region of contact, with the orifices exiting from the conical surface.

3. The apparatus of claim 2 wherein the plurality of orifices is between 3 and 11 in number inclusively.

4. The apparatus of claim 3 wherein the number of orifices is 7.

5. The apparatus of claim 1 wherein the plurality of orifices is between 3 and 11 in number inclusively.

6. The apparatus of claim 5 wherein the number of orifices is an odd number.

7. A gas cap for producing an angled spray stream from an arc spray extension apparatus, the apparatus comprising a spray gun body, a pair of tubular wire guides held by the gun body so as to guide two metal wires to a region of contact at tips of the wires, and a wire feeding mechanism operatively connected to feed the wires respectively through the wire guides, the wires being receptive of an arc current to effect an arc and thereby molten metal at the wire tips;

the gas cap comprising a base and a projection extending therefrom, the base being adapted for affixing the gas cap to the gun body with the projection extending forwardly, the projection having a plurality of orifices therein receptive of pressurized gas to generate gas jets, the orifices being disposed with substantially equal spacing arcuately such that, with the gas cap affixed to the gun body, the jets are directed with a radially inward component toward the region of contact to effect atomization of the molten metal into a spray stream, the orifices having axes that are uniformly offset forwardly and tangentially from radial so as to create a vortex flow such that the spray stream is effected in the form of a conical fan, whereby insertion of the spray stream centrally into a hole can effect a coating circumferentially on an inside surface of the hole.

8. The gas cap of claim 7 wherein the projection has a forwardly facing depressed conical surface proximate the region of contact, with the orifices exiting from the conical surface.

9. The gas cap of claim 8 wherein the plurality of orifices is between 3 and 11 in number inclusively.

10. The gas cap of claim 9 wherein the number of orifices is 7.

11. The gas cap of claim 7 wherein the plurality of orifices is between 3 and 11 in number inclusively.

12. The gas cap of claim 11 wherein the number of orifices is an odd number.

* * * * *